US007144666B2

(12) United States Patent
Lee et al.

(10) Patent No.: US 7,144,666 B2
(45) Date of Patent: Dec. 5, 2006

(54) TONER USED WITH ELECTROPHOTOGRAPHY

(75) Inventors: Duck-hee Lee, Seoul (KR); Jong-moon Eun, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 223 days.

(21) Appl. No.: 10/781,653

(22) Filed: Feb. 20, 2004

(65) Prior Publication Data

US 2004/0170913 A1 Sep. 2, 2004

(30) Foreign Application Priority Data

Feb. 24, 2003 (KR) ..... 10-2003-0011340
Feb. 24, 2003 (KR) ..... 10-2003-0011341

(51) Int. Cl.
*G03G 9/08* (2006.01)

(52) U.S. Cl. ..... 430/108.6; 430/108.7

(58) Field of Classification Search ..... 430/108.6, 430/108.7

See application file for complete search history.

(56) References Cited

U.S. PATENT DOCUMENTS 6,022,661 A * 2/2000 Kurose et al. ..... 430/108.7
2003/0157419 A1* 8/2003 Miyakawa et al. ..... 430/108.6
2003/0165761 A1* 9/2003 Arai et al. ..... 430/108.6
2003/0190543 A1* 10/2003 Sugiura et al. ..... 430/108.6

FOREIGN PATENT DOCUMENTS

JP 1195486 8/1989
JP 11295921 10/1999

* cited by examiner

*Primary Examiner*—John L Goodrow
(74) *Attorney, Agent, or Firm*—Stanzione & Kim, LLP

(57) ABSTRACT

A toner having toner particles containing a binder resin and a colorant; and a first external additive having 0.1 to 3.0 wt % of large silica particles with an average particle size of 20 to 200 nm; a second external additive having 0.1 to 3.0 wt % of small silica particles with an average particle size of 5 to 20 nm; a third external additive having 0.1 to 2.0 wt % of hydrophobic titanium dioxide microparticles with a resistance of 105 to 1012 Ωcm; and a fourth external additive having at least one of 0.1 to 2.0 wt % of conductive titanium dioxide particles with a resistance of 1 to 105 Ωcm and 0.1 to 2.0 wt % of positively chargeable aluminum oxide particles. Therefore, a thin toner layer with a uniform toner amount is formed on a toner carrier and stable charge distribution and toner flowability are maintained for a long time, thereby resulting in prevention of fog and toner scattering, and improvements in developing efficiency and toner durability.

15 Claims, No Drawings

TONER USED WITH ELECTROPHOTOGRAPHY

CROSS-REFERENCE TO RELATED APPLICATIONS

This application claims priority from Korean Patent Application No. 2003-11341 and 2003-11340, filed on Feb. 24, 2003, in the Korean Intellectual Property Office, the disclosure of which is incorporated herein by reference in its entirety.

BACKGROUND OF THE INVENTION

1. Field of the Invention

The present invention relates to a toner used with electrophotography, and more particularly, to a toner used with electrophotography and having improved developing efficiency in which two types of silica particles with different particle sizes, hydrophobic titanium dioxide microparticles, and conductive titanium dioxide/positively chargeable aluminum oxide particles are used as external additives.

2. Description of the Related Art

As a developing method used in electrophotography, there are a two-component developing method and a one-component developing method. The one-component developing method is subdivided into a magnetic one-component developing method and a non-magnetic one-component developing method. The magnetic one-component developing method is a method that uses a magnetic one-component developing toner. The non-magnetic one-component developing method is a method that transfers a non-magnetic one-component developing toner layer formed on a developing roller to a photoconductor using a contact or non-contact developing method.

Among various developing methods using a one-component developer, a contact-type, non-magnetic, one-component developing method has excellent cost competitiveness, but provides poor dot reproducibility and line reproducibility, and low resolution, which renders creation of high quality images difficult. On the other hand, with respect to a non-contact-type, non-magnetic, one-component developing method, a simple developing apparatus is used, which promotes miniaturization of the apparatus. Also, this method enables color reproducibility, edge reproducibility, good tone gradation, and high resolution printing, thereby providing high quality images.

A non-contact-type, non-magnetic developing method includes a charging operation, a light-exposing operation, a developing operation, a transferring operation, and a cleaning operation. In the case of a toner used in a conventional non-contact-type, non-magnetic developing method, a colorant, a charge control agent, and a releasing agent are uniformly dispersed in a binder resin to improve color, chargeability, and fixing properties. Also, various types of external additives are added to toner particles to impart functionality, such as flowability, charge stability, and cleaning properties, to the toner particles.

Japanese Patent Laid-Open Publication No. Hei. 11-0095486 discloses a toner containing conductively treated silica particles as an external additive. Japanese Patent Laid-Open Publication No. Hei. 11-295921 discloses a toner containing three types of silica particles with different particle sizes as an external additive.

In the non-contact-type, non-magnetic, one-component developing method, it is important to form a thin toner layer on a developing roller opposite to a developing area, to prevent a fog (or background) in a non-image area and toner scattering. However, due to an increased charge amount of a toner during forming of a thin toner layer on a developing roller, developing efficiency is rapidly lowered, thereby decreasing an image density. Also, when the charge amount of a toner is adjusted to a low level to prevent the lowering of a developing efficiency, the increase of fog formation and contamination by toner scattering are likely to occur.

Therefore, stable maintenance of the charge amount and charge distribution of a toner as well as formation of a thin toner layer on a developing roller opposite to a developing area is required. This is accomplished by appropriately selecting the type and composition of external additives added to toner particles.

SUMMARY OF THE INVENTION

Accordingly, it is an aspect of the present invention to provide a toner with improved developing efficiency and durability, which is free from fog and toner scattering, by appropriately selecting the types and contents of external additives.

Additional aspects and advantages of the invention will be set forth in part in the description which follows and, in part, will be obvious from the description, or may be learned by practice of the invention.

The foregoing and/or other aspects of the present invention are achieved by providing a toner comprising toner particles containing a binder resin and a colorant; and a first external additive including 0.1 to 3.0 wt % of large silica particles with an average particle size of 20 to 200 nm; a second external additive including 0.1 to 3.0 wt % of small silica particles with an average particle size of 5 to 20 nm; a third external additive including 0.1 to 2.0 wt % of hydrophobic titanium dioxide microparticles with a resistance of $10^5$ to $10^{12}$ Ωcm; and a fourth external additive including at least one of 0.1 to 2.0 wt % of conductive titanium dioxide particles with a resistance of 1 to $10^5$ Ωcm and 0.1 to 2.0 wt % of positively chargeable aluminum oxide particles, based on the weight of the toner particles.

The large silica particles may have an average particle size of 30 to 150 nm and the small silica particles may have an average particle size of 7 to 16 nm.

The conductive titanium dioxide particles may have a resistance of 1 to $10^4$ Ωcm and the hydrophobic titanium dioxide microparticles may have a resistance of $10^7$ to $10^{11}$ Ωcm.

The conductive titanium dioxide particles may have an average particle size of 30 to 500 nm and the hydrophobic titanium dioxide microparticles may have an average particle size of 10 to 50 nm.

The conductive titanium dioxide particles may have an average particle size of 40 to 300 nm and the hydrophobic titanium dioxide microparticles may have an average particle size of 15 to 40 nm.

The positively chargeable aluminum oxide particles may have a charge amount of +50 to +500 μC/g, and preferably +100 to +300 μC/g. The positively chargeable aluminum oxide particles may have an average particle size of 0.1 to 3.0 μm, preferably 0.1 to 2.0 μm.

A weight ratio of the large silica particles to the small silica particles may be in a range of 1:1 to 3:1, preferably 1.5:1 to 2.5:1.

The binder resin may have an acid number of 3 to 12 mgKOH/g.

A toner of the present invention may be a non-magnetic one-component toner.

DETAILED DESCRIPTION OF THE INVENTION

Hereinafter, the present invention will be described in more detail.

A toner of the present invention includes toner particles, which contain a binder resin and a colorant, and external additives comprising two types of silica particles with different particle sizes, hydrophobic titanium dioxide microparticles, and at least one of conductive titanium dioxide and positively chargeable aluminum oxide particles.

In a toner of the present invention, large silica particles, which are employed as the first external additive, mainly act as spacer particles to prevent deterioration of the toner and improve transferability. Also, small silica particles, which are employed as the second external additives, mainly act to impart flowability to the toner. As the content of the large silica particles increases, M/A(mg/cm$^2$) and flowability decrease. On the other hand, as the content of the small silica particles increases, M/A increases and fixing property decreases. The term, "M/A" as used herein indicates the weight of a toner per unit area measured on a developing roller after passing through a toner layer regulating member. Considering that improvement in fog prevention characteristics and toner scattering prevention can be accomplished at a low M/A, it is important to form a thin toner layer with M/A of 0.3 to 1.0 mg/cm$^2$. In this regard, improvement of toner properties can be accomplished by optimally adjusting the particle size, content, and combination ratio of the large silica particles and the small silica particles.

The large silica particles have an average particle size of 20 to 200 nm, preferably 30 to 150 nm.

If the particle size of the large silica particles is less than 20 nm, the large silica particles may be easily buried in a toner, which makes it difficult to act as spacer particles. On the other hand, if it exceeds 200 nm, the large silica particles may be easily separated from a toner and may not act as spacer particles.

The small silica particles have an average particle size of 5 to 20 nm, preferably 7 to 16 nm.

If the particle size of the small silica particles is less than 5 nm, the small silica particles may be easily buried in minute depressions of the surfaces of toner particles, and chargeability and flowability may not be easily controlled. On the other hand, if the particle size of the small silica particles exceeds 20 nm, flowability of a toner may be insufficient.

The large silica particles are used in an amount of 0.1 to 3.0 wt % relative to the weight of the toner particles. If the content of the large silica particles is less than 0.1 wt %, the large silica particles may not act as spacer particles. On the other hand, if the content of the large silica particles exceeds 3.0 wt %, the large silica particles may be separated from a toner or may cause damage to the surface of a photoconductor, and an image resolution may be lowered.

The small silica particles are used in an amount of 0.1 to 3.0 wt % relative to the weight of the toner particles. If the content of the small silica particles is less than 0.1 wt %, flowability of a toner may be lowered. If the content of the small silica particles exceeds 3.0 wt %, the fixing property of a toner may be lowered and the charge amount of a toner may be excessively increased.

The combination ratio of the large silica particles to the small silica particles may vary according to a developing system. However, for the purpose of formation of a thin toner layer, the content of the large silica particles may be no less than that of the small silica particles.

In this regard, it is preferable to set the weight ratio of the large silica particles to the small silica particles at a range of 1:1 to 3:1, and more preferably 1.5:1 to 2.5:1.

Within the weight ratio of the above range, M/A of 0.3 to 1.0 mg/cm$^2$ can be stably obtained, and fog and toner scattering can be prevented. If the content of the large silica particles is lower than that of the small silica particles (i.e., the weight ratio is less than 1:1), the thickness of a toner layer may increase, a charge amount may decrease, and a fixing property may be lowered. On the other hand, if the content of the large silica particles is excessively higher than that of the small silica particles (i.e., the weight ratio is more than 3:1), flowability of a toner may worsen.

To improve charge stability and flowability, a toner of the present invention includes hydrophobic titanium dioxide microparticles and at least one of conductive titanium dioxide and positively chargeable aluminum oxide particles, in addition to the two types of the silica particles with different particle sizes.

If the hydrophobic titanium dioxide microparticles are used alone, the chargeability of a toner may be lowered during long-term usage, thereby causing toner scattering or uneven charge distribution. To solve these problems, at least one of the conductive titanium dioxide particles and the positively chargeable aluminum oxide particles are added as an additional external additive.

The hydrophobic titanium dioxide microparticles impart flowability to a toner, and the conductive titanium dioxide particles impart long-term charge stability to a toner. In this regard, the adjustment of the content and average particle size of these two components may be important, like the large and small silica particles. Appropriate selection of the resistance of these two components may also be important.

The conductive titanium dioxide particles have a resistance of 1 to $10^5$ Ωcm, preferably 1 to $10^4$ Ωcm, and more preferably 4 to $10^3$ Ωcm.

The hydrophobic titanium dioxide microparticles have a resistance of $10^5$ to $10^{12}$ Ωcm, preferably $10^6$ to $10^{11}$ Ωcm, and more preferably $10^7$ to $10^{10}$ Ωcm.

The conductive titanium dioxide particles have an average particle size of 30 to 500 nm, preferably 40 to 300 nm. The hydrophobic titanium dioxide microparticles have an average particle size of 10 to 50 nm, preferably 15 to 40 nm.

If the average particle size of the conductive titanium dioxide particles is less than 30 nm, chargeability of a toner may be lowered. If the average particle size of the conductive titanium dioxide particles exceeds 500 nm, charge stability may be lowered. If the average particle size of the hydrophobic titanium dioxide microparticles is less than 10 nm, chargeability of a toner may be lowered, and if the average particle size of the hydrophobic titanium dioxide particles exceeds 50 nm, flowability may be lowered.

The hydrophobic titanium dioxide microparticles are used in an amount of 0.1 to 2.0 wt % relative to the weight of the toner particles.

If the content of the hydrophobic titanium dioxide microparticles is less than 0.1 wt %, flowability may be lowered. On the other hand, if it exceeds 2.0 wt %, charge stability and fixing properties may be lowered.

Microparticles are generally subjected to surface treatment with an organic material to decrease their high cohesive force. This surface treatment with an organic material imparts high resistance and hydrophobicity to the microparticles. On the other hand, a surface treatment with an inorganic material imparts conductivity and low resistance to the microparticles.

The conductive titanium dioxide particles are used in an amount of 0.1 to 2.0 wt % relative to the weight of the toner particles. If the content of the conductive titanium dioxide particles is less than 0.1 wt %, sufficient addition effect may not be obtained. On the other hand, if it exceeds 2.0 wt %, there may arise problems such as poor fixing properties, contamination of a developing member due to separation from a toner, an image fog, and damage to a developing member such as a photoconductor.

The positively chargeable aluminum oxide particles may have a charge amount of +50 to +500 μC/g, preferably +100 to +300 μC/g. If the charge amount of the positively chargeable aluminum oxide particles exceeds +50 μC/g, uneven charge distribution of a toner and fog in a non-image area may occur. If it is less than +50 μC/g, sufficient addition effect may not be obtained.

The positively chargeable aluminum oxide particles have an average particle size of 0.1 to 3.0 μm, preferably 0.1 to 2.0 μm. If the average particle size of the positively chargeable aluminum oxide particles is less than 0.1 μm, chargeability of a toner may be lowered. On the other hand, if it exceeds 3.0 μm, the positively chargeable aluminum oxide particles may be easily separated from a toner, and a developing member such as a photoconductor may be easily damaged.

The positively chargeable aluminum oxide particles are used in an amount of 0.1 to 2.0 wt % relative to the weight of the toner particles.

If the content of the positively chargeable aluminum oxide particles is less than 0.1 wt %, sufficient addition effect may not be obtained. On the other hand, if it exceeds 2.0 wt %, there may arise problems such as uneven charge distribution of a toner, poor fixing properties, an image fog due to separation from a toner, and damage to a developing member such as a photoconductor.

The conductive titanium dioxide particles and positively chargeable aluminium oxide particles are used as the fourth external additive separately or together.

Toner particles of the present invention include a binder resin.

Various known resins can be used as the binder resin. Examples of the binder resin include polystyrene, poly-p-chlorostyrene, poly-α-methylstyrene, styrene based copolymer such as styrene-chlorostyrene copolymer, styrene-propylene copolymer, styrene-vinyltoluene copolymer, styrene-vinylnaphthalene copolymer, styrene-methylacrylate copolymer, styrene-ethylacrylate copolymer, styrene-propylacrylate copolymer, styrene-butylacrylate copolymer, styrene-octylacrylate copolymer, styrene-methylmethacrylate copolymer, styrene-ethylmethacrylate copolymer, styrene-propylmethacrylate copolymer, styrene-butylmethacrylate copolymer, styrene-α-chloromethylmethacrylate copolymer, styrene-acrylonitrile copolymer, styrene-vinylmethylether copolymer, styrene-vinylethylether copolymer, styrene-vinylethylketone copolymer, styrene-butadiene copolymer, styrene-acrylonitrile-indene copolymer, styrene-maleic acid copolymer, and styrene-maleic ester, polymethylmethacrylate, polyethylmethacrylate, polybutylmethacrylate, and a copolymer thereof, polyvinylchloride, polyvinyl acetate, polyethylene, polypropylene, polyester, polyurethane, polyamide, epoxy resin, polyvinylbutyral resin, rosin, modified rosin, terpene resin, phenolic resin, aliphatic or cycloaliphatic hydrocarbon resin, aromatic petroleum resin, chlorinated paraffin, and paraffin wax, and a mixture thereof. Among them, polyester resin has good fixing properties and is suitable for a color developer.

Preferably, the binder resin may be used in an amount of 70 to 95 wt % of the toner particles.

The properties of a toner of the present invention are also affected by the acid number of the binder resin. As the acid number of the binder resin increases, adherence of a toner on a blade increases. In this regard, a low acid number is preferred. Preferably, the acid number of the binder resin is in a range of 3 to 12 mgKOH/g. If the acid number is less than 3 mgKOH/g, chargeability may be lowered. On the other hand, if the acid number exceeds 12 mgKOH/g, stability of the charge amount of a toner with a change of humidity may be adversely affected, and adherence of a toner to a developing member may increase.

Toner particles of the present invention include a colorant.

Examples of the colorant include carbon black, aniline black, aniline blue, charcoal blue, chromium yellow, ultramarine blue, dupone oil red, quinoline yellow, methylene blue chloride, phthalocyanine blue, malachite green oxalate, lamp black, Rose Bengal, rhodamine colorant or dye, anthraquinone dye, monoazo- and bisazo-dye, and quinachridone magenta dye. The colorant is used in a sufficient amount so that a visible image is formed to an appropriate density.

When carbon black is used as the colorant, it has preferably a primary particle size of 25 to 70 nm, in particular 30 to 55 nm, and specific surface area of 110 $m^2/g$ or less. Therefore, good dispersability and pulverizability of the colorant with other components during melting and/or blending are ensured.

The colorant may be used in an amount of 0.5 to 10 wt %, preferably 0.5 to 8 wt %, and more preferably 1 to 5 wt % of the toner particles.

If the content of the colorant is less than 0.5 wt %, a coloration effect may be insufficient. On the other hand, if it exceeds 10 wt %, even though an image density is saturated, the developing property of a toner may be lowered. For example, due to low electric resistance of a toner, an insufficient amount of triboelectric charge may be obtained, thereby causing a fog.

Toner particles of the present invention may include a charge control agent (CCA) and a releasing agent such as wax, which are uniformly dispersed in the binder resin, to enhance chargeability and fixing property.

It is required that a toner is stably adsorbed to the surface of a developing roller by an electrostatic force. Since the electrostatic force of a toner is generated by a charge blade, a fast charge speed is required. The charge control agent is thus necessary for the charge stability of a toner.

Examples of the charge control agent include useful dyes such as metal-containing azo dyes, salicylic acid metal complexes, nigrosin dyes, quaternary ammonium salts, triphenylmethane based control agents, and oil blacks, naphthenic acids, salicylic acids, octylic acids, and their metal salts such as manganese salts, cobalt salts, iron salts, zinc salts, aluminum salts, and lead salts, and alkylsalicylic acid metal chelates.

Preferably, the charge control agent is used in an amount of 0.1 to 10 wt %. If the content of the charge control agent is less than 0.1 wt %, sufficient addition effect may not be obtained. On the other hand, if the content of the charge control agent exceeds 10 wt %, charge instability may be caused.

Recently, low temperature fixing properties of a toner are required for low energy consumption and warm-up time reduction. For this, a releasing agent, such as wax that provides good fixing properties at a wide temperature range, is required.

The releasing agent (lubricant) may be a polyalkylene wax such as low molecular weight polypropylene and low molecular weight polyethylene, paraffin wax, high fatty acid, and fatty acid amide. The releasing agent is used in an amount of 0.1 to 10 wt %. If the content of the releasing agent is less than 0.1 wt %, sufficient addition effect may not be obtained. On the other hand, if it exceeds 10 wt %, there may arise problems such as poor offset resistance, low flowability, and caking.

The charge control agent and the releasing agent may be dispersed in or coated on toner particles. The former is general.

A toner of the present invention may further include a high fatty acid or a salt thereof to protect a photoconductor and to prevent deterioration of a developing property, thereby resulting in a high quality image.

EXAMPLE 1

Composition of Toner Particles

Binder Resin

Polyester: 92 wt %

Acid Number: 7 mgKOH/g

Colorant (Carbon Black)

MA100 (Mitsubishi Chemical Co., Ltd.): 5 wt %

Charge Control Agent (Fe Complex)

T77 (Hodogaya Chemical Co., Ltd.): 1 wt %

Releasing Agent (low molecular weight polypropylene wax)

660P (Sanyo Chemical Industries Ltd.): 2 wt %

Toner particles with the particle size of 8 μm were prepared using these above components according to a common toner preparation method and then added with following external additives to thereby obtain toner of the present invention:

Large Silica Particles (NAX50, Nippon Aerosol Co., Ltd.)

| | |
|---|---|
| Average Particle Size | 30 nm |
| Content | 1 wt % |

Small Silica Particles (R972, Nippon Aerosol Co., Ltd.)

| | |
|---|---|
| Average particle size | 16 nm |
| Content | 0.6 wt % |

Conductive Titanium Dioxide Particles (ET-500W, Ishihara Sangyo Kaisha, Co.)

| | |
|---|---|
| Average Particle Size | 200 nm |
| Content | 1 wt % |
| Resistance | 5 Ωcm |

Hydrophobic Titanium Dioxide Microparticles (NKT90, Nippon Aerosol Co., Ltd.)

| | |
|---|---|
| Average Particle Size | 20 nm |
| Content | 1 wt % |
| Resistance | $10^{10}$ Ωcm |

EXAMPLE 2

Toner of the present invention was prepared in the same manner as in Example 1 except that the following positively chargeable aluminum oxide particles were used instead of the conductive titanium dioxide particles.

Positively Charged Aluminum Oxide Particles (ET-500W, Ishihara Sangyo Kaisha Co.)

| | |
|---|---|
| Average Particle Size | 1.0 μm m |
| Content | 1 wt % |
| Charge Amount | +300 μC/g |

COMPARATIVE EXAMPLE 1

Toner was prepared in the same manner as in Example 1 except that two types of silica particles and hydrophobic titanium dioxide microparticles were added to toner particles as external additives.

EXPERIMENTAL EXAMPLE

Image qualities of the toner according to Examples and Comparative Example were evaluated by printing 2.5% characters using Samsung ML-7300 developing device (printer mode: paper cycle of 1-2-1). The image density (I/D), fog in a non-image area (B/G), and streak (vertical stripe type image fog due to adherence of the toner particles to a blade) of images were measured to evaluate the characteristics of the toner. Here, I/D was evaluated by measuring the density of a black pattern on a paper, B/G was evaluated by measuring the concentration of the toner on a non-image area of a photoconductor using a densitometer (SpectroEye, GretagMacbeth Co.). Dot reproducibility and streak were evaluated by the naked eye.

The operational condition of a developing device was as follows:

Surface Potential (Vo): −700 V

Latent Image Potential (VL): −100 V

Developing Roller Applied Voltage

Vp-p=1.8 KV, Frequency=2.0 kHz,

Vdc=−250 V, Duty Ratio=40% (Square Wave)

Developing Gap (GAP): 250μ

Developing Roller (1) Aluminum

Roughness: Rz=1~2.5 (after coated with nickel)

(2) Rubber Roller

Resistance: $5\times10^5$ Ω

Hardness: 50

Toner

Charge Amount (q/m)=−14 to −20 μC/g (measured on developing roller after passing through a toner layer regulating member)

Amount of Toner=0.4 to 0.8 mg/cm$^2$

The above experimental results are presented in Tables 1 through 3 below.

The evaluation standard for I/D is as follows: "O": more than 1.3, "Δ": 1.1 to 1.3, and "X": less than 1.1.

The evaluation standard for B/G is as follows: "O": 0.14 or less, "Δ": 0.15 to 0.16, and "X": 0.17 or more.

With respect to dot reproducibility and streak, "O" indicates good dot reproducibility and little or no streak, "Δ" indicates acceptable dot reproducibility and some streaks and "X" indicates poor dot reproducibility and many streaks.

TABLE 1

Evaluation Results of Toner of Example 1

| | N.P.* | | | | | |
|---|---|---|---|---|---|---|
| Section | Initial | 2,000 | 4,000 | 6,000 | 8,000 | 10,000 |
| I/D | ○ | ○ | ○ | ○ | ○ | ○ |
| B/G | ○ | ○ | ○ | ○ | ○ | Δ |
| Dot Reproducibility | ○ | ○ | ○ | ○ | Δ | Δ |
| Streak | ○ | ○ | ○ | ○ | ○ | ○ |

*N.P.: Number of papers

TABLE 2

Evaluation Results of Toner of Example 2

| | N.P* | | | | | |
|---|---|---|---|---|---|---|
| Section | Initial | 2,000 | 4,000 | 6,000 | 8,000 | 10,000 |
| I/D | ○ | ○ | ○ | ○ | ○ | ○ |
| B/G | ○ | ○ | ○ | ○ | ○ | Δ |
| Dot Reproducibility | ○ | ○ | ○ | ○ | Δ | Δ |
| Streak | ○ | ○ | ○ | ○ | ○ | ○ |

*N.P.: Number of papers

TABLE 3

Evaluation Results of Toner of Comparative Example

| | N.P.* | | | | | |
|---|---|---|---|---|---|---|
| Section | Initial | 2,000 | 4,000 | 6,000 | 8,000 | 10,000 |
| I/D | ○ | ○ | ○ | ○ | Δ | X |
| B/G | ○ | ○ | ○ | Δ | X | X |
| Dot Reproducibility | ○ | ○ | ○ | Δ | Δ | X |
| Streak | ○ | ○ | ○ | Δ | Δ | X |

*N.P.: Number of papers

As seen from the above experimental results, when the two types of silica particles with different particle sizes, the hydrophobic titanium dioxide microparticles, and at least one of the positively chargeable aluminum oxide and conductive titanium dioxide particles were used as external additives, all of I/D, B/G, dot reproducibility, and streak characteristics were improved. In particular, as the number of printed papers increased, improvements in B/G and streak characteristics were excellent.

As apparent from the above descriptions, appropriate adjustment of the types and contents of toner external additives enables formation of a thin toner layer with a uniform toner amount (M/A) of 0.3 to 1.0 mg/cm$^2$ on a toner carrier. Therefore, stable charge distribution and toner flowability are maintained for a long time, thereby resulting in prevention of fog and toner scattering, and improvements in developing efficiency and toner durability.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A toner comprising:

toner particles containing a binder resin and a colorant; and a first external additive including large silica particles in an amount of 0.1 to 3.0 wt % relative to the toner particles and having an average particle size of 20 to 200 nm;

a second external additive including small silica particles in an amount of 0.1 to 3.0 wt % relative to the toner particles and having an average particle size of 5 to 20 nm;

a third external additive including 0.1 to 2.0 wt % of hydrophobic titanium dioxide microparticles relative to the weight of the toner particles, with a resistance of $10^5$ to $10^{12}$ Ωcm; and a fourth external additive including at least one of 0.1 to 2.0 wt % of conductive titanium dioxide particles relative to the weight of the toner particles with a resistance of 1 to $10^5$ Ωcm, and 0.1 to 2.0 wt % of positively chargeable aluminum oxide particles, relative to the weight of the toner particles.

2. The toner of claim 1, wherein the hydrophobic titanium dioxide microparticles have a resistance of $10^7$ to $10^{10}$ Ωcm inclusive.

3. The toner of claim 1, wherein the hydrophobic titanium dioxide microparticles have an average particle size of 10 to 50 nm inclusive.

4. The toner of claim 1, wherein the hydrophobic titanium dioxide microparticles have an average particle size of 15 to 40 nm inclusive.

5. The toner of claim 1, wherein the conductive titanium dioxide particles have a resistance of 1 to $10^4$ Ωcm inclusive.

6. The toner of claim 1, wherein the conductive titanium dioxide particles have an average particle size of 30 to 500 nm inclusive.

7. The toner of claim 1, wherein the conductive titanium dioxide particles have an average particle size of 40 to 300 nm inclusive.

8. The toner of claim 1, wherein the positively chargeable aluminum oxide particles have a charge amount of +100 to +300 μC/g.

9. The toner of claim 1, wherein the positively chargeable aluminum oxide particles have an average particle size of 0.1 to 3 μm.

10. The toner of claim 1, wherein the positively chargeable aluminum oxide particles have an average particle size of 0.1 to 2.0 μm.

11. The toner of claim 1, wherein a weight ratio of the large silica particles to the small silica particles is in a range of 1:1 to 3:1.

12. The toner of claim 11, wherein a weight ratio of the large silica particles to the small silica particles is in a range of 1.5:1 to 2.5:1.

13. The toner of claim 1, wherein the binder resin has an acid number of 3 to 12 mgKOH/g.

14. The toner of claim 1, wherein the toner is a non-magnetic one-component toner.

15. A toner comprising:

toner particles containing a binder resin and a colorant; and a first external additive including large silica particles in an amount of 0.1 to 3.0 wt % relative to the toner particles and having an average particle size of 20 to 200 nm;

a second external additive including large silica particles in an amount of 0.1 to 3.0 wt % relative to the toner particles and having an average particle size of 5 to 20 nm;

a third external additive including hydrophobic titanium dioxide microparticles; and a fourth external additive including at least one of conductive titanium dioxide particles and positively chargeable aluminum oxide particles.

* * * * *